US008833108B2

(12) United States Patent
Lonati et al.

(10) Patent No.: US 8,833,108 B2
(45) Date of Patent: Sep. 16, 2014

(54) DOUBLE-CYLINDER CIRCULAR MACHINE, PARTICULARLY FOR KNITTING HOSIERY ITEMS OR THE LIKE, WITH SIMPLIFIED ACTUATION MECHANISM

(75) Inventors: Ettore Lonati, Botticino (IT); Tiberio Lonati, Brescia (IT); Fausto Lonati, Brescia (IT)

(73) Assignee: Lonati S.p.A., Brescia? (IT)

( * ) Notice: Subject to any disclaimer, the term of this patent is extended or adjusted under 35 U.S.C. 154(b) by 0 days.

(21) Appl. No.: 13/988,402

(22) PCT Filed: Sep. 22, 2011

(86) PCT No.: PCT/EP2011/066530

§ 371 (c)(1),
(2), (4) Date: May 20, 2013

(87) PCT Pub. No.: WO2012/072296

PCT Pub. Date: Jun. 7, 2012

(65) Prior Publication Data

US 2013/0233024 A1 Sep. 12, 2013

(30) Foreign Application Priority Data

Dec. 2, 2010 (IT) ..... MI2010A2227

(51) Int. Cl.
*D04B 15/99* (2006.01)
*D04B 9/10* (2006.01)
*D04B 15/00* (2006.01)

(52) U.S. Cl.
CPC *D04B 9/10* (2013.01); *D04B 15/99* (2013.01); *D04B 15/00* (2013.01)
USPC ..... 66/18

(58) Field of Classification Search
CPC ..... D04B 9/00; D04B 9/10; D04B 9/46–9/56; D04B 15/99
USPC ..... 66/13, 14, 17, 18
See application file for complete search history.

(56) References Cited

U.S. PATENT DOCUMENTS 2,258,927 A * 10/1941 Clarke ..... 66/14
2,606,432 A 8/1952 Camnasio et al.

(Continued)

FOREIGN PATENT DOCUMENTS

GB 372510 A * 5/1932
GB 2288819 A * 11/1995 ..... D04B 9/10

(Continued)

OTHER PUBLICATIONS

International Search Report for related PCT App. No. PCT/EP2011/066530 dated Mar. 19, 2012.

*Primary Examiner* — Danny Worrell
(74) *Attorney, Agent, or Firm* — Husch Blackwell, LLP

(57) ABSTRACT

A double-cylinder circular machine, particularly for knitting hosiery items, with simplified actuation mechanism, comprising a supporting structure which comprises a footing, which supports a lower needle cylinder, and a column which extends substantially vertically, protrudes upwardly from the footing and supports an upper needle cylinder, which is arranged above and coaxially with respect to the lower needle cylinder, and further comprising elements for the actuation of the lower needle cylinder and of the upper needle cylinder with a rotary motion about a common axis, the actuation elements comprising an electric motor which is connected kinematically to the lower needle cylinder and to the upper needle cylinder and is accommodated inside the column.

5 Claims, 1 Drawing Sheet

(56) References Cited

U.S. PATENT DOCUMENTS

| | | | | |
|---|---|---|---|---|
| 4,122,690 | A * | 10/1978 | Moreni | 66/14 |
| 5,187,951 | A | 2/1993 | Stroud et al. | |
| 2013/0233024 | A1 * | 9/2013 | Lonati et al. | 66/14 |

FOREIGN PATENT DOCUMENTS

| | | | |
|---|---|---|---|
| WO | WO2012/072296 | | 6/2012 |
| WO | WO 2012072296 | A1 * | 6/2012 |
| WO | WO 2013041267 | A1 * | 3/2013 |

* cited by examiner

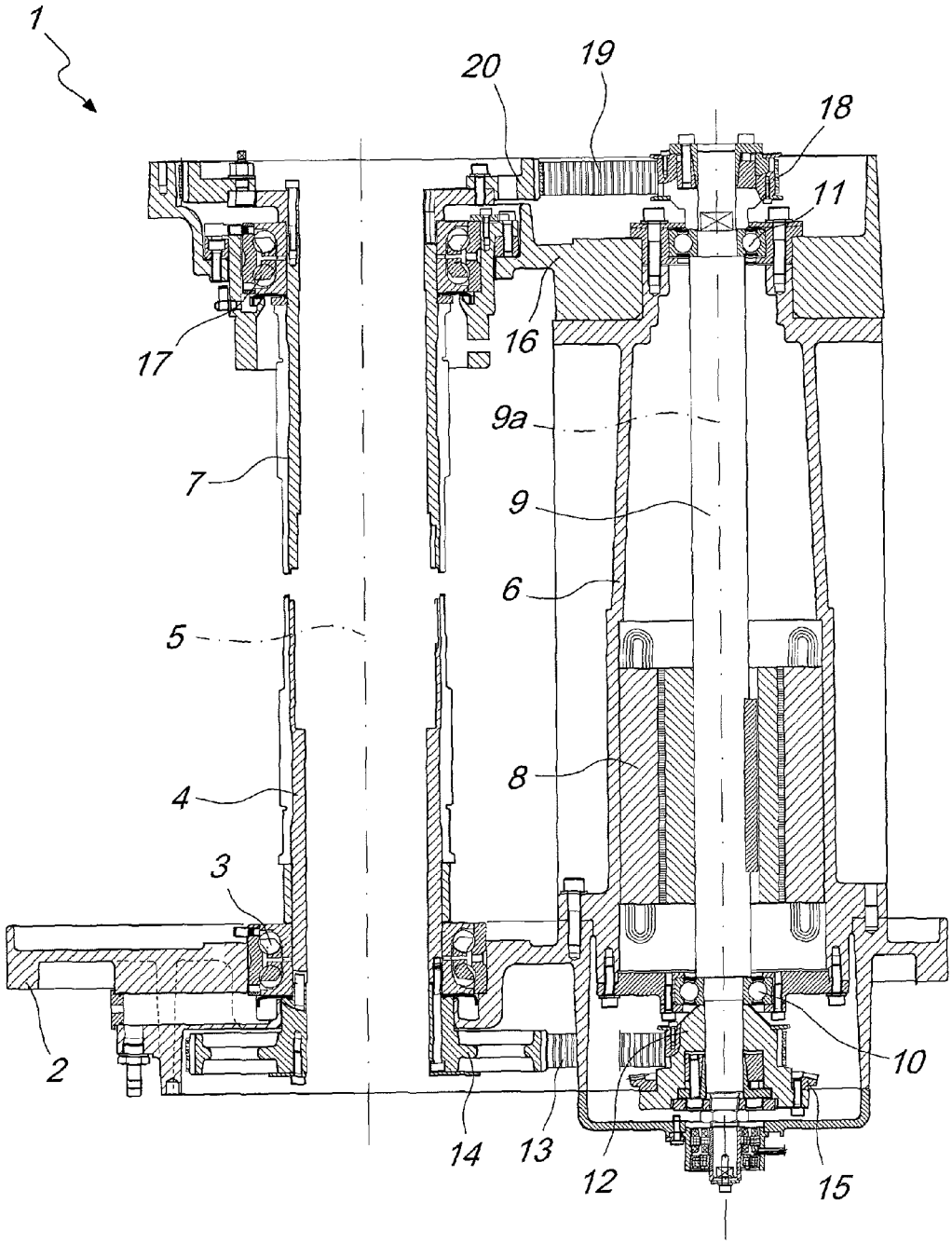
1
20
19
18
11
17
16
9a
7
9
6
5
8
4
3
2
10
14
13
12
15

DOUBLE-CYLINDER CIRCULAR MACHINE, PARTICULARLY FOR KNITTING HOSIERY ITEMS OR THE LIKE, WITH SIMPLIFIED ACTUATION MECHANISM

TECHNICAL FIELD

The present invention relates to a double-cylinder circular machine, particularly for knitting hosiery items or the like, with simplified actuation mechanism.

BACKGROUND ART

As is known, double-cylinder circular machines for knitting hosiery items or tubular articles in general comprise a supporting structure which is composed substantially of a footing which rests on the ground and supports the lower needle cylinder so that it can rotate about its own axis, which is oriented vertically.

The footing also supports, by means of a column that rises vertically from the footing, the upper needle cylinder, which is arranged above and coaxially with respect to the lower needle cylinder.

The actuation cams of the sliders or transfer sinkers are arranged around the lower needle cylinder and around the upper needle cylinder and are accommodated inside axial slots defined on the lateral surface of the needle cylinders. The sliders are adapted to engage respectively the lower or upper tip or head of the needles of such machines, which are typically provided with a tip or head at both of their ends. The sliders are provided with heels, which protrude from the lateral surface of the needle cylinder in which they are accommodated and can be engaged, as a consequence of the rotation of the needle cylinders about their own axis relative to the actuation cams, with paths defined by the actuation cams. Such paths are shaped so as to cause the movement of the sliders with respect to the needle cylinders parallel to the axis of the needle cylinders. This movement of the sliders is used to actuate the needles, for example to move the needles to knit at a feed or drop of the machine, or to transfer the needles from the lower needle cylinder to the upper needle cylinder or vice versa.

The lower needle cylinder can be actuated with a rotary motion about its own axis by means of an electric motor, which is accommodated inside the footing and is connected, by means of its shaft, to the lower needle cylinder by way of a gear-type or toothed-belt transmission. The same electric motor is connected to the upper needle cylinder so as to actuate the upper needle cylinder with a rotary motion about its own axis, synchronously with the rotation of the lower needle cylinder. More particularly, the shaft of the electric motor accommodated in the footing is connected, by way of a gear-type or toothed-belt transmission, to a transmission shaft, which is supported, so that it can rotate about its own vertically oriented axis, inside the column that supports the upper needle cylinder. This transmission shaft is connected, proximate to its upper end, to the upper needle cylinder by way of a gear-type or toothed-belt transmission.

The arrangement of the electric motor that actuates the needle cylinders inside the footing can hinder and make it difficult to place, in this portion of the machine, other components required for its operation, such as for example the electrical cables that connect the several components of the machine to the electrical panel, which is usually applied to a door located on a lateral face of the footing.

Moreover, the arrangement of the electric motor in the footing can make it difficult to install devices for tensioning the articles being knitted, which descend into the lower needle cylinder and exit from its lower end.

DISCLOSURE OF THE INVENTION

The aim of the present invention is to solve the problems described above, by providing a double-cylinder circular machine, particularly for knitting hosiery items or the like, in which the space required by the electric motor that actuates the needle cylinders does not hinder the installation of other components of the machine.

Within this aim, an object of the invention is to provide a machine in which the transmission of the motion from the electric motor to the needle cylinders is simplified with respect to machines of the conventional type.

Another object of the invention is to provide a machine which is structurally simple and can be manufactured at competitive costs.

This aim, as well as these and other objects which will become better apparent hereinafter, are achieved by a double-cylinder circular machine, particularly for knitting hosiery items or the like, comprising a supporting structure which comprises a footing, which supports, rotatably about its vertically oriented axis, a lower needle cylinder, and a column which extends substantially vertically, protrudes upwardly from said footing and supports, rotatably about its own axis, an upper needle cylinder which is arranged above and coaxially with respect to said lower needle cylinder, actuation means being provided for the actuation of said lower needle cylinder and of said upper needle cylinder with a rotary motion about the common axis, said actuation means comprising an electric motor which is connected kinematically to said lower needle cylinder and to said upper needle cylinder, characterized in that said electric motor is accommodated inside said column.

BRIEF DESCRIPTION OF THE DRAWINGS

Further characteristics and advantages of the invention will become better apparent from the description of a preferred but not exclusive embodiment of the machine according to the invention, illustrated by way of non-limiting example in the accompanying drawings, wherein the only FIGURE shows schematically the machine according to the invention in cross-section along a vertical plane that passes through the axis of the needle cylinder and with some components of the machine omitted for the sake of simplicity and for greater clarity.

WAYS OF CARRYING OUT THE INVENTION

With reference to the FIGURE, the machine according to the invention, generally designated by the reference numeral 1, comprises a footing 2, of which only the upper part has been shown for the sake of simplicity, which supports, by means of a bearing 3, a lower needle cylinder 4, which is thus able to rotate about its vertically oriented axis 5, with respect to the footing 2.

A column 6 is fixed to the upper face of the footing 2, extends substantially vertically and supports an upper needle cylinder 7, which is arranged above and coaxially with respect to the lower needle cylinder 4.

The machine 1 is provided with means for the actuation of the lower needle cylinder 4 and of the upper needle cylinder 7 with a rotary motion about the common axis 5.

Said actuation means comprise an electric motor 8, which is connected kinematically to the lower needle cylinder 4 and to the upper needle cylinder 7 and which, according to the invention, is accommodated inside the column 6.

Preferably, the column 6 constitutes the enclosure of the electric motor 8.

The electric motor 8 is provided with a shaft 9, to which the rotor of the electric motor 8 is fixed and the shaft 9 is supported, so that it can rotate about its own axis 9*a*, which is parallel to the axis 5, by the column 6 by means of bearings 10, 11.

The lower end of the shaft 9 protrudes downwardly from the column 6 and extends into the footing 2. A toothed pulley 12 is keyed on said lower end of the shaft 9 and, by means of a toothed belt 13, is connected to a toothed pulley 14, which is fixed coaxially to the lower needle cylinder 4 at its lower end.

A bevel gear 15 is fixed coaxially to the toothed pulley 12 and a pinion, not shown for the sake of simplicity, can mesh with it and can be actuated manually to cause the manual rotation of the needle cylinders 4, 7 if needed.

The upper end of the column 6 is fixed to a cross-member 16 which, by means of a bearing 17, supports the upper needle cylinder 7 so that it can rotate about its own axis 5.

The upper end of the shaft 9 protrudes upwardly from the column 6. A toothed pulley 18 is keyed on said upper end of the shaft 9 and, by means of a toothed belt 19, is connected to a toothed pulley 20, which is fixed to the upper needle cylinder 7 at its upper end.

For the sake of completeness in description, it should be noted that the transmission ratio between the shaft 9 and the lower needle cylinder 4 is equal to the transmission ratio between the shaft 9 and the upper needle cylinder 7, so that the needle cylinders 4, 7 rotate at the same speed about the axis 5.

Operation of the machine according to the invention is evident from what has been described and illustrated.

In practice, the actuation of the electric motor 8 causes, by means of the toothed-belt transmission 13 and by means of the toothed-belt transmission 19, the actuation of the lower needle cylinder 4 and the actuation of the upper needle cylinder 7 with a rotary motion about the axis 5.

The arrangement of the electric motor 8 in the column 6 that supports the upper needle cylinder 7 allows to free, inside the footing 2, the space that in conventional machines is occupied by the electric motor, simplifying the arrangement of the other components of the machine. Moreover, this particular arrangement eliminates the need for an additional shaft in order to transmit motion from the electric motor 8 to the upper needle cylinder 7.

In practice it has been found that the machine according to the invention fully achieves the intended aim, since the particular arrangement of the electric motor allows to solve the space occupation problems inside the footing and also simplifies the transmission of motion from the electric motor to the upper needle cylinder.

The machine thus conceived is susceptible of numerous modifications and variations, all of which are within the scope of the appended claims; all the details may further be replaced with other technically equivalent elements.

In practice, the materials used, as well as the dimensions, may be any according to requirements and to the state of the art.

The disclosures in Italian Patent Application No. MI2010A002227 from which this application claims priority are incorporated herein by reference.

The invention claimed is:

1. A double-cylinder circular machine comprising a supporting structure which comprises a footing, which supports, rotatably about its vertically oriented axis, a lower needle cylinder, and a column which extends substantially vertically, protrudes upwardly from said footing and supports, rotatably about its own axis, an upper needle cylinder, which is arranged above and coaxially with respect to said lower needle cylinder, actuation means being provided for the rotational movement of said lower needle cylinder and of said upper needle cylinder about a common axis, said actuation means comprising an electric motor which is connected kinematically to said lower needle cylinder and to said upper needle cylinder, wherein said electric motor is accommodated inside said column.

2. The machine according to claim 1, wherein said column constitutes the enclosure of said electric motor.

3. The machine according to claim 1, wherein said electric motor is provided with a shaft, which is oriented so that its axis is parallel to the axis of said lower needle cylinder, and in which a lower end protrudes into said footing and an upper end protrudes upwardly from said column, a lower end of said shaft being connected to said lower needle cylinder and an upper end of said shaft being connected to said upper needle cylinder.

4. The machine according to claim 3, wherein a first toothed pulley is keyed on the lower end of said shaft and is connected, by means of a toothed belt, to a second toothed pulley, which is fixed coaxially to the lower end of said lower needle cylinder.

5. The machine according to claim 4, wherein a third toothed pulley is keyed to the upper end of said shaft and is connected, by means of a toothed belt, to a fourth toothed pulley, which is fixed coaxially to the upper end of said upper needle cylinder.

* * * * *